US006537021B2

(12) United States Patent
Howard et al.

(10) Patent No.: US 6,537,021 B2
(45) Date of Patent: Mar. 25, 2003

(54) ABRADEABLE SEAL SYSTEM

(75) Inventors: Peter Howard, Stony Point, NY (US); Ravi Shankar, Mahwah, NJ (US); Richard Fenton, S. Kingstown, RI (US)

(73) Assignee: Chromalloy Gas Turbine Corporation, Orangeburg, NY (US)

( * ) Notice: Subject to any disclaimer, the term of this patent is extended or adjusted under 35 U.S.C. 154(b) by 7 days.

(21) Appl. No.: 09/875,764

(22) Filed: Jun. 6, 2001

(65) Prior Publication Data

US 2002/0197155 A1 Dec. 26, 2002

(51) Int. Cl.[7] ..... F01D 11/08

(52) U.S. Cl. ..... 415/173.4; 416/241 B; 428/662

(58) Field of Search ..... 415/173.4, 174, 415/174.4; 416/241 B, 241 R; 428/662, 663, 641

(56) References Cited

U.S. PATENT DOCUMENTS

| | | | | | |
|---|---|---|---|---|---|
| 4,269,903 | A | | 5/1981 | Clingman et al. | 428/591 |
| 4,291,089 | A | | 9/1981 | Adamovic | 428/325 |
| 4,299,865 | A | | 11/1981 | Clingman et al. | 427/243 |
| 4,481,237 | A | | 11/1984 | Bosshart et al. | 427/376.4 |
| 4,588,607 | A | | 5/1986 | Matarese et al. | 427/34 |
| 4,664,973 | A | | 5/1987 | Otfinoski et al. | 428/307.3 |
| 4,696,855 | A | | 9/1987 | Pettit et al. | 428/312.8 |
| 4,759,957 | A | | 7/1988 | Eaton et al. | 427/226 |
| 4,936,745 | A | | 6/1990 | Vine et al. | 415/173.4 |
| 5,024,884 | A | | 6/1991 | Otfinoski | 428/328 |
| 5,080,934 | A | | 1/1992 | Naik et al. | 427/271 |
| 5,536,022 | A | * | 7/1996 | Sileo et al. | 277/235 A |
| 5,704,759 | A | | 1/1998 | Draskovich et al. | 415/170.1 |
| 5,705,231 | A | | 1/1998 | Nissley et al. | 427/453 |
| 5,780,116 | A | * | 7/1998 | Sileo et al. | 427/456 |
| 5,791,871 | A | | 8/1998 | Sech et al. | 415/173.1 |
| 5,935,407 | A | * | 8/1999 | Nenov et al. | 205/183 |
| 5,951,892 | A | | 9/1999 | Wolfla et al. | 219/121.69 |
| 5,997,248 | A | * | 12/1999 | Ghasripoor et al. | 415/173.4 |
| 6,057,047 | A | | 5/2000 | Maloney | 428/623 |
| 6,096,381 | A | * | 8/2000 | Zheng | 427/454 |
| 6,102,656 | A | | 8/2000 | Nissley et al. | 415/174.4 |
| 6,194,086 | B1 | * | 2/2001 | Nenov et al. | 428/621 |
| 6,365,222 | B1 | * | 4/2002 | Wagner et al. | 427/140 |

* cited by examiner

*Primary Examiner*—Edward K. Look
*Assistant Examiner*—James M McAleenan
(74) *Attorney, Agent, or Firm*—Mitchell D. Bittman

(57) ABSTRACT

A gas turbine engine abradeable seal system is provided comprising a seal assembly and a cooperating interacting turbine blade. The turbine blade has a tip portion containing cubic boron nitride abrasive particles and the seal assembly has a superalloy substrate with a bond coat thereon having a surface roughness of at least 300 RA and a porous ceramic abradeable seal material on the bond coat having a porosity of from 5 to 15 volume %.

11 Claims, No Drawings

ABRADEABLE SEAL SYSTEM

BACKGROUND OF THE INVENTION

This invention relates to an abradeable seal system, more particularly to the use of a seal assembly with increased erosion resistance.

The efficiency of modem gas turbine engines depends upon a tight seal between the rotating components (blades) and the stationary component (shroud) in the fan, compressor and turbine. This seal is established by allowing the blades to cut (abrade) a groove in an abradeable seal material which prevents a substantial volume of air from leaking past the blade tip. Traditionally the turbine seal materials have been fabricated from woven metallic fibers or sintered metallic particles and brazed in place. While these materials are easily abraded due to their high internal porosity and low strength, their resistance to particle erosion is poor which results in rapid loss of material. This loss of material degrades the seal and the efficiency of the engine rapidly decreases. Seal materials in the more advanced engine utilize thermal sprayed coatings which perform the same function as the braided abradeable seals, but which are easier to apply and easier to replace when an engine is overhauled.

The use of thermal spray powders to form abradeable seals is known in the art as shown by U.S. Pat. No. 4,291,089. Such powders are used to form a coating on a substrate to provide an abradeable seal, that is to say a coating which seals the space between the substrate and an adjacent surface movable relative thereto, and which is abraded to a controlled extent by relative movement between the substrate and the adjacent surface. Such a seal is initially formed by thermal spraying a powder onto the substrate to form a coating with a slightly greater thickness than the spacing between the substrate and the adjacent surface, so that the coating is abraded by relative movement between the substrate and the adjacent surface to a slightly lesser thickness corresponding to the spacing between the substrate and the adjacent surface so as to provided an efficient seal there between. Such seals are used for example with turbine or compressor blades of gas turbine engines, such as those used in aircraft, to provide a seal between the blades and the turbine or compressor housing.

One of the problems in providing a suitable abradeable seal is to produce a thermally sprayed coating which, on the one hand has sufficient structural strength which nevertheless is low enough to provide abradability, and which, on the other hand, has a sufficiently high resistance to erosion by particles impinging on the abradeable seal coating during use. For example, in the case of gas turbine or compressor blades, the seal coating is subjected to impingement by abrasive particles entrained in the air and ingested by the engine.

An abradeable ceramic seat is shown in U.S. Pat. No. 4,936,745 which provides a porous ceramic abradeable layer having a porosity of from about 20 to 35 vol %; however, the high porosity provides decreased erosion resistance which is a disadvantage in the severe environment of the high pressure turbine.

SUMMARY

Briefly, this invention provides a gas turbine engine abradeable seal system comprising a seal assembly and a cooperating interacting turbine blade. The turbine blade has a tip portion containing cubic boron nitride abrasive particles for contacting the seal assembly to provide sealing. The seal assembly has a superalloy substrate having an MCrAlY bond coat thereon with a surface roughness of at least 300 RA, and a porous ceramic abradeable seal material on the bond coat having a porosity of from 5 to 15 vol %.

DETAILED DESCRIPTION

An abradeable seal system for gas turbine engines is provided with increased erosion resistance, while still proving an effective seal between the turbine blade and the stationary component. The seal system comprises the seal assembly and the turbine blade which cooperates and interacts with the seal assembly to cut a path into the seal assembly to create the seal. The turbine blade is a rotating member having an abrasive tip portion disposed in rub relationship to a stationary, abradeable seal assembly such that the abrasive tip portion cuts into the abradeable surface of the seal assembly.

The turbine blade has a tip portion which contains cubic boron nitride (CBN) abrasive particles to cut into the seal assembly. The CBN particles are highly effective in cutting through the abradeable seal material. The tip portion containing CBN abrasive particles may be applied by entrapment plating in an oxidation resistant metal matrix. A method as disclosed in U.S. Pat. No. 5,935,407, which is incorporated herein by reference, may be utilized which applies a bond coat to the turbine tip substrate by low pressure plasma spraying, then anchoring to the bond coat abrasive particles by entrapment plating in metal matrix. This method is preferred because of the increased bond strength of the abrasive tip to the turbine blade.

The seal assembly provides an abradeable seal anchored to a superalloy substrate. Generally, the substrate is a turbine or compressor housing or a liner attached thereto, with the superalloy being a cobalt or nickel based superalloy. To anchor the abradeable seal material to the substrate a bond coat is applied to the substrate surface having a surface roughness of greater than 300 RA; preferably greater than 350 RA. The bond coat is an MCrAlY wherein M is Co and/or Ni, which can be modified with Pt and/or diffusion aluminide coating. The increased environmental resistance of the abradeable material combined with the increased cutting ability of the CBN particles in the blade tip provides increased shear to the seal assembly. The increased surface roughness of the bond coat provides the increased bond strength needed to anchor the abradeable material. The bond coat can be applied by plasma spraying, either low pressure or air, to a thickness of about 4 to 15 mils, preferably about 5 to 10 mils. To achieve the surface roughness an MCrAlY is plasma sprayed with a particle size of up to about 150 microns. The bond coat is heat treated for diffusion bonding, either before or after the ceramic is applied, at a temperature of about 1900–2050° F. for 2 to 5 hours, typically 1975° F. for 4 hours.

To the bond coat, a porous ceramic abradeable seal material is applied having a porosity of from 5 to 15 vol %, preferably 10 to 15 vol %. The decreased level of porosity of this material provides increased environmental resistance allowing the seal to exhibit a longer useful life in the turbine engine. The increased cutting effectiveness of the CBN particles in the tip combined with the increased bond strength of the bond coat provides an effective seal system with increased seal life.

The ceramic abradeable seal material is a zirconia stabilized with 6 to 9% yttria. To create the porosity, the ceramic material is plasma sprayed with a fugitive material, preferably a polyester. To provide a porosity on the order of 5 to 15% a ceramic particle size of less than about 200 microns, preferably about 20 to 125 microns, can be mixed with up to 1.5% by weight, preferably about 1% to 1.5% by weight, of a polyester having a particle size of 45 to 125 microns. The mixture is then plasma sprayed to a thickness of from about 10 to 80 mils, preferably 20 to 40 mils. Optionally, the polyester is removed by heating at above 1300° F.; however, it has been observed that most of the polyester is already removed during the plasma spraying process and the remaining polyester can be tolerated in the system.

EXAMPLE

A turbine blade tip was coated with an abrasive tip portion by the process as described in U.S. Pat. No. 5,935,407, wherein first a bond coat of CoNiCrAlY was low pressure plasma sprayed onto the turbine tip to a thickness of 4 mils, then CBN particles were entrapment plated by nickel plating, followed by nickel plating with a solution containing fine CoCrAlHf particles to a nominal thickness of 5 mils. After a homogenization heat treatment of 1975° F. for 4 hours, the blade tip was aluminized by the gas phase process.

A seal assembly was then prepared by applying a CoNiCrAlY bond coat onto Hastelloy X superalloy 4 inch×1.4 inch coupons by low pressure plasma spraying CoNiCrAlY particles having a mixture of particle size ranges of 45 to 90 microns and 20 to 38 microns to a thickness of 7 mils, providing a surface roughness of between 360 and 400 RA. A porous ceramic abradeable seal material was prepared by mixing 98.75 weight % yttria-stabilized zirconia of a 22 to 125 micron particle size with 1.25 weight % of polyester particles having a particle size of 45 to 125 microns providing a ceramic with a porosity of 12.5%. This seal material was applied to the bond coated coupons by air plasma spraying.

The coupons with the abradeable seal material was rub tested in a high temperature abradeable rig using the CBN tipped blades, with the rig targeted for a 20 mil incursion depth target. Excellent abradeability was demonstrated under the following test parameters:

| Test Temperature | Tip Velocity | Incursion Rate | Groove Depth |
|---|---|---|---|
| 1832° F. | 1150 fps | 5 microns/sec | 17.5 mils |
| 2192° F. | 1345 fps | 5 microns/sec | 17.5 mils |

Additional tests were conducted with a target incursion depth of 20 mils.

One sample was tested with the seal assembly (bond coat plus ceramic top coat with a porosity of 12.5%) subjected to a diffusion heat treatment of 1975° F. for 4 hours after the ceramic coating had been applied. The test results were as follows:

| Test Temperature | Tip Velocity | Incursion Rate | Groove Depth |
|---|---|---|---|
| 1832° F. | 1150 fps | 5 microns/sec | 12.8 mils |

Samples with various porosity levels were also tested with similar results:

| Ceramic Porosity | Test Temp | Tip Velocity | Incursion Rate | Groove Depth |
|---|---|---|---|---|
| 10% | 1832° F. | 1150 fps | 5 microns/sec | 19.4 mils |
| 15% | 1832° F. | 1150 fps | 5 microns/sec | 18.0 mils |
| 10% | 2192° F. | 1345 fps | 5 microns/sec | 21.5 mils |
| 15% | 2192° F. | 1345 fps | 5 microns/sec | 18.0 mils |

In all tests the blade tip showed no observable wear.

What is claimed is:

1. A gas turbine engine abradeable seal system comprising:

a seal assembly and a cooperating interacting turbine blade;

the turbine blade having a tip portion containing cubic boron nitride abrasive particles for contacting the seal assembly to provide sealing;

the seal assembly having a superalloy substrate, an MCrAlY bond coat on the surface of the substrate having a surface roughness of greater than 300 RA, wherein M is selected from the group consisting of Co, Ni or Ni and Co, and a porous ceramic abradeable seal material on the bond coat having a porosity of from 5 to 15 vol %.

2. System of claim 1 wherein the bond coat has a surface roughness of greater than 350 RA.

3. System of claim 2 wherein the bond coat is plasma sprayed.

4. System of claim 3 wherein the porous ceramic abradeable seal material is zirconia stabilized with 6–9% yttria.

5. System of claim 3 wherein the bond coat is from about 4 to 15 mils thick.

6. System of claim 4 wherein the abradeable porous ceramic material is from about 10 to 80 mils thick.

7. System of claim 2 wherein the cubic boron nitride particles in the tip portion are anchored to the blade tip by entrapment plating in an oxidation resistant metal matrix.

8. System of claim 6 wherein the porous ceramic abradeable seal material has a porosity of from 10 to 15 vol %.

9. System of claim 6 wherein the ceramic material is plasma sprayed with a fugitive material.

10. System of claim 9 wherein the ceramic material has a particle size of less than about 200 microns.

11. System of claim 10 wherein the fugitive material is a polyester having a particle size of about 20 to 125 microns at about 1 to 1.5% by weight of the ceramic abradeable seal material.

* * * * *